United States Patent [19]

Levey et al.

[11] 3,930,619

[45] Jan. 6, 1976

[54] ADJUSTABLE ORIFICE SPRAY GUN

[75] Inventors: Gustave S. Levey; Edward Moser, both of Houston, Tex.

[73] Assignee: Gustave S. Levey, Houston, Tex.

[22] Filed: Nov. 18, 1974

[21] Appl. No.: 524,416

[52] U.S. Cl. ..... 239/526; 239/534; 239/602

[51] Int. Cl.[2] ..... B05B 7/02; B05B 1/30; B05B 1/00

[58] Field of Search ..... 239/534, 412, 602, 601, 239/526, 499; 138/45

[56] References Cited

UNITED STATES PATENTS

| | | | |
|---|---|---|---|
| 2,781,058 | 2/1957 | Warhus | 138/45 |
| 2,899,979 | 8/1959 | Dahl et al. | 138/45 |
| 3,000,576 | 9/1961 | Levey et al. | 239/526 |
| 3,072,151 | 1/1963 | Quercia | 138/45 |
| 3,077,903 | 2/1963 | Honsinger | 138/45 |
| 3,095,175 | 6/1963 | Iketoni | 138/45 |
| 3,253,782 | 5/1966 | Fischer et al. | 239/499 |
| 3,837,363 | 9/1974 | Meronek | 138/45 |
| R24,534 | 9/1958 | Dahl | 138/45 |
| R25,052 | 10/1961 | Burkland et al. | 138/45 |

OTHER PUBLICATIONS

Lonergan, Richard P.; Hall, Lawrence B., "The Regulation of Flow Through Residual Spray Nozzles" *Bulletin of the World Health Organization* 1959, Vol. 20, pp. 955-961, 961-971

*Primary Examiner*—Lloyd L. King
*Attorney, Agent, or Firm*—McNenny, Farrington, Pearne & Gordon

[57] ABSTRACT

A paint spray gun of the airless type is disclosed. The spray gun includes a central passageway for delivering liquid paint under pressure to a spray tip having an elongated, sharp edged spray opening and a pre-orifice adjustable in cross-sectional area positioned upstream in the passageway from the spray opening. The pre-orifice is formed by an elastomeric member having an opening therethrough co-axially aligned with the passageway and the spray opening. The elastomeric member is arranged for axial loading and elastic deformation to vary the cross-sectional area of the pre-orifice opening by operation of a control knob externally mounted on the body portion of the spray gun.

12 Claims, 6 Drawing Figures

Fig. 1
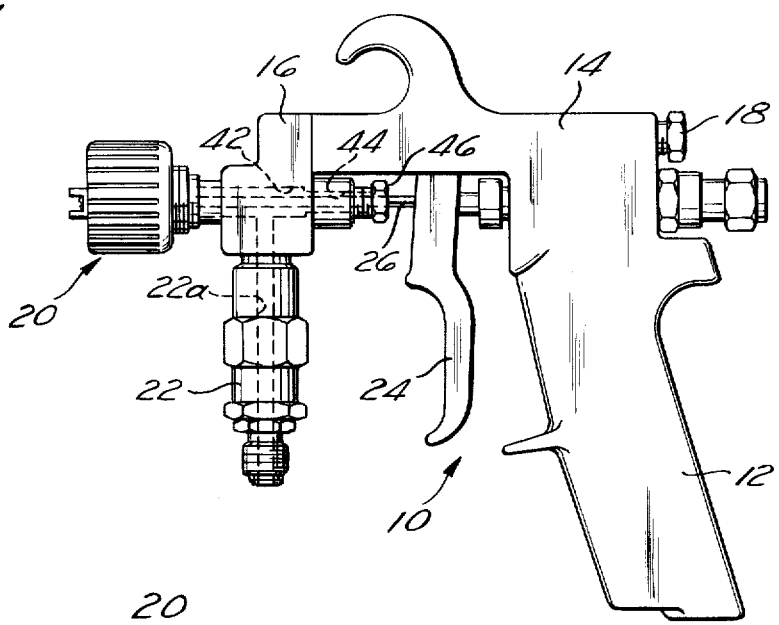
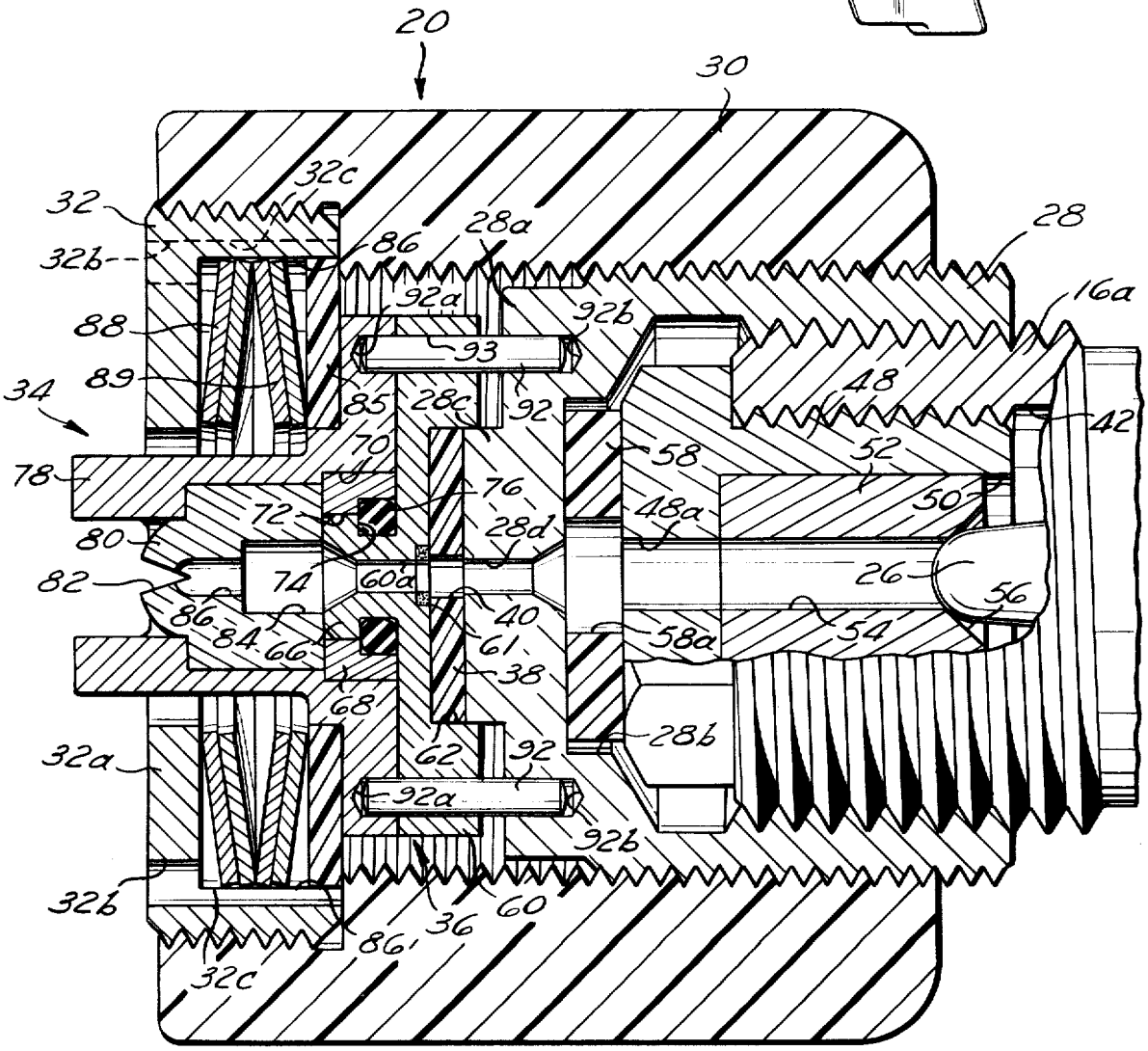
Fig. 2

ADJUSTABLE ORIFICE SPRAY GUN

BACKGROUND OF THE INVENTION

This invention relates to spray guns for liquids such as paint or the like and, more particularly, to a spray gun for hydraulically atomizing the liquid to be sprayed.

In a hydraulically atomizing spray system or "airless spray", the liquid is forced through a spray tip or nozzle opening having sharp edges at sufficiently high velocities to provide atomization of the liquid. The nozzle opening has an elliptically shaped cross-section with sharp vertices to produce an elliptical or oval shaped spray pattern. In airless spraying techniques, the hydraulic pressures are relatively high and typically range from about 1,500 psig to about 3,000 psig.

The advantages of airless spraying are discussed in U.S. Pat. No. 3,000,576 to Levey et al. In accordance with this prior patent, the non-uniform spray pattern having thickened portions or "pig-tails" which had theretofore characterized airless spray techniques was eliminated by the use of a restricted pre-orifice having a circular cross-section disposed upstream from the nozzle opening.

The improvements disclosed in U.S. Pat. No. 3,000,576 were founded upon the recognition of the fact that the occurrence of such nonuniform spray patterns was associated with the formation of a vena contracta upon acceleration of the liquid with a large pressure drop through the nozzle opening which prevents full atomization of the liquid at the vertices of the spray pattern. The formation of a harmful vena contracta was eliminated by accelerating the liquid with a large pressure drop through the restricted pre-orifice to provide a submerged jet moving through the nozzle opening by its own kinetic energy at substantially the same velocity. By controlling the liquid in this manner, a substantially uniform pressure and velocity was obtained across the area of the nozzle opening, so that the liquid was uniformly atomized and distributed across the spray pattern with a uniform reduction in density or feathering at the margins of the pattern.

For purposes of obtaining optimum atomization quality, the cross-sectional area of the pre-orifice opening should be substantially equal to the cross-sectional area of the nozzle opening. Satisfactory results are obtained as long as the area of the pre-orifice is not less than about one-fourth or more than about twice the area of the nozzle opening. A number of variously sized, pre-orifice units are required to accommodate the full commercial range of spray tip opening sizes in accordance with the teachings of the said U.S. Pat. No. 3,000,576. In order to maintain optimum atomization, the variously sized pre-orifice units must be changed and such may involve the disassembly of a significant portion of the spray gun and, at least, results in a considerable loss of production time.

Further, in some paint spraying applications, particularly in construction or maintenance work, speed of application is paramount and the quality of atomization may be sacrificed for the maximum fan width applied as quickly as possible. To that end, an operator may forego the use of a preorifice in order to obtain as wide a spray fan width as possible since it has been observed that the use of a pre-orifice will reduce the fan width and the volume delivered. Thus, a similar loss of production time may once again be encountered while the operator inserts a pre-orifice after the faster "rough" applications have been applied.

The necessity of employing a number of variously sized pre-orifice units and the loss of production time associated therewith have been eliminated by the adjustable pre-orifice assembly disclosed in applicants' co-pending U.S. Pat. application Ser. No. 443,480, filed Feb. 19, 1974. In accordance with the improvements set forth therein, a pre-orifice assembly or capsule provides a pre-orifice which is adjustable in cross-sectional area to accommodate the full commercial range of spray tips. The area of the pre-orifice opening is adjusted by means of a control member mounted on the external body portion of the spray gun. In addition to providing the optimum 1:1 ratio, the adjustable pre-orifice also provides area ratios substantially in excess of 2:1 for most of the spray tips commonly employed to enable an operator to achieve full spray pattern width potential in high speed rough work by simply adjusting the pre-orifice to its maximum size. Similarly, the spray fan width may be narrowed or decreased for specific trim or finishing applications by reducing the size of the pre-orifice.

SUMMARY OF THE INVENTION

It has now been discovered that an adjustable preorifice may be provided by means of an elastomeric or resilient member or disc mounted upstream from the spray tip. The elastomeric member includes an opening or aperture therethrough which defines the pre-orifice opening. The pre-orifice opening is adjustable in cross-sectional area upon elastic deformation of the elastomeric member by operation of a control means mounted on the spray gun.

In accordance with the present invention, pre-orifice means including relatively movable rigid wall means for engaging and confining the opposite sides of the elastomeric disc are provided. The rigid wall means include bores aligned with and of substantially no greater diameter than the pre-orifice opening. Upon closing relative movement of the movable rigid wall means, the cross-sectional area of the pre-orifice opening is correspondingly decreased to a value less than that of the adjacent bores.

In a preferred form, the pre-orifice means also include rigid wall means for confining the elastomeric disc against radially outward flow.

The pre-orifice means and the spray tip are secured to the spray gun by the control means, and they are retained in fluid tight sealing engagement by the axial loads imposed by the control means. In this regard, the elastomeric disc also functions as a sealing means or gasket to assure the maintenance of the fluid tight relationship in the chain of parts.

In the illustrated embodiments, a pre-orifice assembly or capsule is provided having the elastomeric disc mounted therein with a radially confining interference fit and the preorifice opening co-axially disposed with respect to the passageway and the nozzle opening. The capsule cooperates with a fixed portion of the spray gun to provide the relatively movable rigid wall means. Upon operation of the control means, the capsule member is relatively axially displaced with respect to the fixed portion of the spray gun in order to apply preselected, elastically deforming loads to the elastomeric disc and correspondingly vary the size of the pre-orifice opening therethrough.

The spray tip is mounted to the spray gun by the control means which comprises a control knob threadedly engaged with the body portion of the spray gun. The spray tip is arranged to axially move with the pre-orifice capsule upon adjustment of the control knob, and rotational locking means comprising interfitting orientation surfaces extending between the spray tip and body portion angularly fix the spray tip relative to the gun. In order to facilitate deformation of the elastomeric disc, spring means are arranged to axially bias the spray tip and capsule member upon adjustment of the control knob.

The control knob includes an annular chamber having the spring means captured therein and encircling the forward portion of the spray tip. A radially extending wall of the annular chamber is provided by a thrust washer which transmits axially biasing loads to the spray tip for varying the pre-orifice cross-sectional area and maintaining the spray tip in fluid tight sealing communication with the discharge end of the passage through the spray gun. Accordingly, the control knob also functions as a retainer nut for the spray tip.

The spray tip may be removed from the gun by simply disengaging the control knob and spring means as a unit from the body portion of the gun. Similarly, the spray tip may be replaced by fitting it to the body portion of the gun and reengaging the control knob. This is a hand operation which may be quickly done by an operator without the use of tools.

In contrast with the present invention, prior art arrangements necessitate the use of a wrench to tighten the retainer nut and fit the spray tip to the gun in a fluid tight seal. The desired angular orientation of the spray tip has to be maintained by hand by an operator as he simultaneously holds the gun and tightens the retainer nut since the spray tip is otherwise free to rotate in accordance with prior art teachings. Further, the angular orientation of the spray tip has to be initially offset from the desired position since the final tightening of the prior art spray tip retainer nut rotates the spray tip. An operator's offset estimate is frequently in error so as to require repeated attempts to obtain the desired orientation and loss of production time.

In the illustrated embodiment, the pre-orifice capsule is detachable connected to the spray tip. The spray tip and pre-orifice capsule provide an integrally removable assembly when the control know is disengaged from the spray gun. Accordingly, if it is necessary to replace the elastomeric disc, it is conveniently removed with the spray tip and pre-orifice capsule as a unit.

The cross-sectional area of the pre-orifice opening is sized to permit unrestricted flow in a full open condition. An operator may quickly adjust the cross-sectional area of the pre-orifice opening to the optimum 1:1 area ratio without disassembly of the gun or of production time. Similarly, the area ratio may be adjusted to provide a decreased spray fan width for specific trim and finishing applications, or to a ratio substantially in excess of 2:1 in order to achieve full spray fan width potential in high speed rough work applications.

Accordingly, an adjustable pre-orifice which is relatively inexpensive and maintenance free is provided in accordance with the present invention. The pre-orifice capsule is arranged to enhance the uniform deformation of the elastomeric member and maintain the walls of the pre-orifice opening with a uniform contour suitable for accelerating the liquid and providing a submerged jet thereof. More particularly, the wall of the pre-orifice opening remains substantially parallel to the axis of the passageway and the liquid flow therethrough. Further, the spray top and pre-orifice capsule may be rapidly and conveniently secured to the gun in fluid tight relationship without the use of tools.

BRIEF DESCRIPTION OF THE DRAWINGS

FIG. 1 is an elevational view of an airless spray gun provided with adjustable pre-orifice spray assembly including a pre-orifice capsule having an elastomeric disc or member mounted therein in accordance with the present invention;

FIG. 2 is a fragmentry, vertical section on an enlarged scale through the valve port and nozzle area portion of the spray gun shown in FIG. 1 depicting the pre-orifice capsule;

DETAILED DESCRIPTION OF THE DRAWINGS

Figure 3:
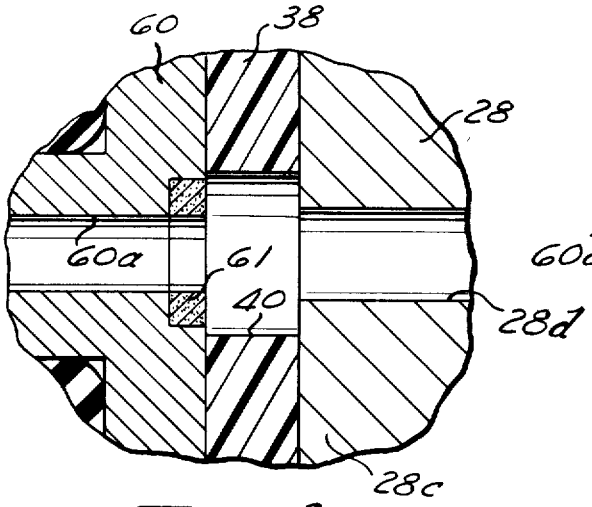
FIG. 3 is a sectional view on an enlarged scale showing the pre-orifice opening through the elastomeric member in an uncompressed condition.

Referring to FIG. 1, an airless spray gun 10 is shown. The spray gun includes a handle portion 12, a forwardly extending stock portion 14 and a spray portion 16 which is secured to the stock portion by means of a bolt 18. In accordance with the present invention, an adjustable pre-orifice spray assembly 20 is fixed to the forward end of the spray portion 16.

The liquid to be sprayed is introduced into the spray gun through a combined swivel fitting and strainer holder 22 which is threadedly connected to the spray portion 16 of the gun. The fitting 22 is adapted to be connected to a source of liquid under pressure (not shown) and the liquid is delivered to the internal portions of the gun through a passageway 22*a* extending through the fitting. The liquid to be sprayed may be pressurized in any conventional manner and a supply hose (not shown) connected to the fitting 22.

The spray gun 10 also includes a pivoted trigger 24 which is fixed to the stem of a needle valve 26 for purposes of operating the spray gun. The needle valve 26 and trigger 24 are biased to a forward, non-spraying position by conventional means. The spray gun is actuated upon movement of the trigger 24 towards the handle 12 and the corresponding, following movement of the needle valve 26 in a rearward direction.

Referring to FIG. 2, the details of the forward portion of the spray gun 10 are shown. The adjustable pre-orifice spray assembly 20 includes an adaptor 28 for mounting the assembly to a cylindrical boss 16*a* extending from the spray portion 16 of the spray gun. The internal threads of the adaptor 28 may be modified to accommodate the particular type of spray gun, and it is axially fixed relative to the spray gun once it has been threadedly engaged therewith.

The pre-orifice spray assembly 20 also includes a control knob 30 and a knob closure member 32 which cooperate to secure a spray nozzle assembly 34 and a pre-orifice capsule or assembly 36 adjacent the discharge end of the spray portion 16 of the spray gun. An elastomeric pre-orifice member of disc 38 having a central pre-orifice opening 40 therethrough is mounted within the capsule 36. As described in greater detail below, the control knob 30 is arranged to axially bias the spray nozzle assembly 34 and pre-orifice assembly 36 in order to elastically deform and vary the cross-sectional area of the pre-orifice opening 40.

The control knob 30 is formed of a low friction plastic material such as Delrin or nylon in order to minimize friction upon the axial loading of the elastomeric member 38. The use of a plastic material is also advantageous in that it adds relatively little weight to the assembly and tends to reduce the overall total weight of the spray gun. As shown in FIG. 1, the external surface of the knob 30 may be provided with serrations to facilitate the rotational adjustment thereof by the operator.

As previously indicated, the liquid to be sprayed is introduced into the spray gun by means of the fitting 22, and more particularly, a passageway 22*a* extending therethrough and communicating with a central passageway or bore 42 in the spray portion 16 of the spray gun. The needle valve 26 is axially movable within the bore 42, and its movement is guided by a counterbore 44 (FIG. 1). The stem of the needle valve extends through the counterbore 44 and a gland nut 46 which seals the free, rearward end of the counterbore.

The forward end of the bore 42 is internally threaded for engagement with the rearward portion of a valve body holder 48. The valve body holder 48 includes a rearwardly opening recess 50. A valve body 52 is press-fitted within the recess 50 and provides a valve port 54 which communicates with the passageway 42. The valve port 54 includes a flared seating surface 56 adjacent the rearward end thereof for sealing, valving engagement with the rounded end of the needle valve 26. The valve body 52 is preferably mode of a hard erosion resistant material such as tungsten carbide.

The forward end of the valve body holder 48 is provided with a hex configuration and it is disposed in sealing engagement with a crushable gasket 58. The gasket 58 is formed of rigid polyethylene or a similar plastic material. The valve body holder 48 includes an opening 48*a* extending through the forward hex portion thereof and communicating between the valve port 54 and an opening 58*a* extending through the gasket 58.

The adapter 28 has a forward wall 28*a* having a rearwardly opening recess 28*b* formed therein for receiving the crushable gasket 58. Accordingly, when the pre-orifice spray assembly 20 is secured to the spray portion 16 of the spray gun, the crushable gasket 58 is compressed between the adapter 28 and the hex portion of the valve body holder 48 to provide a fluid tight seal.

The forward wall 28*a* of the adaptor includes an axially projecting cylindrical shoulder or boss 28*c* which is arranged for sliding engagement with the pre-orifice capsule 36. The adapter 28 is also provided with an axially extending opening 28*d* which communicates with the opening 58*a* through the gasket 58. For purposes of streamlining the flow of liquid, the opening 28*d* is provided with a flared inlet configuration.

Figure 4:
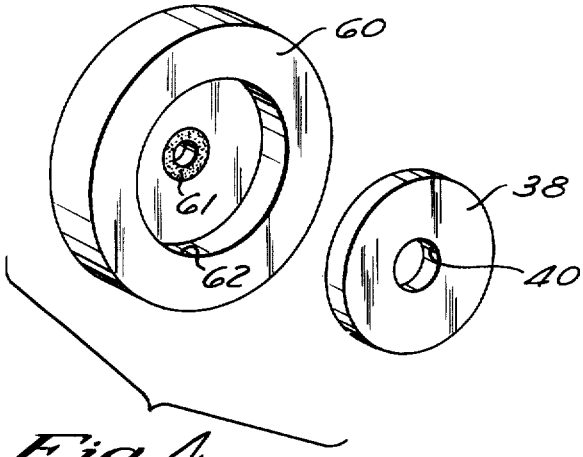
FIG. 4 is an exploded perspective view of the pre-orifice capsule and elastomeric member.

The pre-orifice capsule 36 comprises a cylindrical shaped capsule member 60 having a rearwardly extending cylindrical recess 62 therein (FIG. 4). The elastomeric pre-orifice disc 38 is mounted within the base of the recess 62. As indicated above, the pre-orifice capsule 36 is disposed in sliding engagement with the shoulder 28*c* of the adaptor 28. To that end, the recess 62 is dimensioned for sliding engagement with the shoulder 28*c* of the adaptor 28, and the thickness of the disc 38 is less than the depth of the recess 62. The capsule member 60 is formed of stainless steel, and an erosion resistant insert 61 is provided about the inlet of the bore 60*a* which extends through the capsule member 60. The insert 61 is formed of an aluminum oxide, "synthetic sapphire" material. The capsule member 60 may be formed of any suitable corrosion resistant metal or a rigid plastic material.

The capsule member 60 is provided with an axially projecting member 66 which is detachably connected to the spray nozzle assembly 34. To that end, the spray nozzle assembly 34 includes an annular shaped insert 68 which is press fitted into a recess 70. The insert 68 includes a shouldered recess 72 having a reduced diameter portion sized to receive the forward-most, enlarged portion of the projecting member 66 of the capsule member 60. The axially projecting member 66 is provided with a reduced diameter portion which is axially aligned with the enlarged portion of the recess 72 when the components are assembled to define an annular chamber 74. An elastomeric sealing ring 76 is disposed within the chamber 74 to detachably secure the pre-orifice capsule 36 and the spray nozzle assembly 34 together. In the illustrated embodiments, the elastomeric ring 76 comprises a polyurethane O-ring.

The spray nozzle assembly 34 includes a spray tip holder 78 and a spray tip 80 having a spray tip or nozzle opening 82 therein. The spray tip 80 is press-fitted within the holder 78 and it includes a first bore 84 which communicates with the central bore 60*a* extending through the capsule member 60. A reduced diameter second bore 86 communicates between the first bore 84 and the spray tip opening 82. The spray tip opening 82 has a conventional "flat fan" or "cat eye" configuration comprising a generally elliptical cross-section with sharp vertices adjacent the ends of its major axis. The cat eye configuration is provided by initially forming the bore 86 as a blind bore terminating in a spherically shaped end and thereafter cutting a V-shaped slot into the spray tip so as to intersect the bore 86 and form the spray tip opening 82.

As indicated above, the spray nozzle assembly 34 is secured within the pre-orifice spray assembly 20 by means of the knob closure member 32. The member 32 has a cylindrical configuration including a radially inwardly projecting wall or skirt 32*a* adjacent the forward end thereof. The member 32 is initially threadedly engaged with the control knob 30 using a spanner wrench to engage the spanner holes 32*b*, and it is then fixed to the control knob 30 for axial movement therewith.

As shown in FIG. 2, the member 32 cooperates with a cantilever mounted, plastic thrust washer 85 to define an annular chamber 86 extending around the forward portion of the spray tip holder 78. A pair of double lead Belleville springs or washers 88, 89 are disposed within the chamber 86 for purposes of transmitting axial loading to the elastomeric pre-orifice disc 38 upon adjustment of the control knob 30. To that end, the thrust washer 85 is arranged to transmit the spring loading to the spray tip holder 78. The thrust washer is formed of a plastic material such as Delrin or nylon having a low coefficient of friction.

The Belleville springs 88, 89 assure the uniform transmission of deformation loads to the capsule member 60 and elastomeric member 38 since they bias the thrust washer 85 around its entire, adjacent working surface. Further, the sensitivity of the adjustment or the adjustment range of the control knob 30 or the deformation of the elastomeric member 38 in response to a given rotational adjustment of the knob 30 may be varied by selection of appropriate spring rates.

The elastomeric disc 38 is formed of a suitable abrasion resistant and paint base resistant plastic material which is capable of elastic deformation within the range required to accommodate the commercially available spray tips. The disc 38 is formed of a polyurethane elastomer having an 80 to 85 Shore A durometer, and it has been found to provide satisfactory performance in water and oil base paint spraying applications at pressures in excess of 3,000 psig.

As shown in FIG. 2, the elastomeric disc 38 is in a full open position wherein the cross sectional area of the pre-orifice opening 40 is greater than the cross-sectional area of the adjacent portion of the opening 60*a*. In this condition, the pre-orifice is effectively removed from the spraying operation and the maximum fan width is obtained for high speed rough work. In the full open position, the cross-sectional area of the pre-orifice opening 40 has been slightly reduced by virtue of the control knob 30 being sufficiently tightened to retain the spray nozzle assembly 34 and pre-orifice capsule 36 in fluid tight sealing engagement as described in greater detail below.

Referring to FIG. 3, the elastomeric disc 38 is shown in a nonaxially deformed or uncompressed condition free of the axial loads applied thereto by sufficiently tightening the control knob 30 to retain the chain of parts in fluid tight engagement. In this condition, the cross-sectional area of the pre-orifice opening 40 is further increased as compared with the cross-sectional area of the adjacent portion of the opening 60*a* as shown in FIG. 2.

The elastomeric disc 38 is provided with an outside diameter of approximately one-half inch and the recess 62 is sized to provide an interference fit therewith. The outside dimension of the elastomeric disc is related to the quality and effectiveness of the pre-orifice opening which results. For example, if the outside diameter is reduced to abut three-eighths of an inch, there is a tendency for irregular distortion or deformation to occur, and it does not result in a desirably uniform walled pre-orifice.

The uncompressed diameter of the pre-orifice opening 40 has also been found to be related to the quality of atomization obtained and the ability to control the same throughout the full range of commercial spray tip sizes. Satisfactory results have been obtained when the elastomeric disc in an uncompressed condition has a diameter in the range of from 0.060 inch to 0.125 inch. As shown in FIG. 3, the unrestrained diameter of the uncompressed elastomeric disc 38 is about 0.105 inch.

The pre-orifice opening 40 is provided with a sufficient axial length to stabilize the fluid jet as it is formed therein and cause it to persist as a submerged jet until it reaches and fills the bore 86 leading to the spray tip opening 82. It has been found that these objectives are achieved when the pre-orifice opening is provided with a minimum axial length equal to from about two to about five times its maximum diameter. Accordingly, the elastomeric disc 38 is about one-sixteenth of an inch thick. The pre-orifice opening may be provided with a greater relative axial length without significantly interfering with the volume of liquid or necessitating excessively high hydraulic pressures.

Figure 3A:
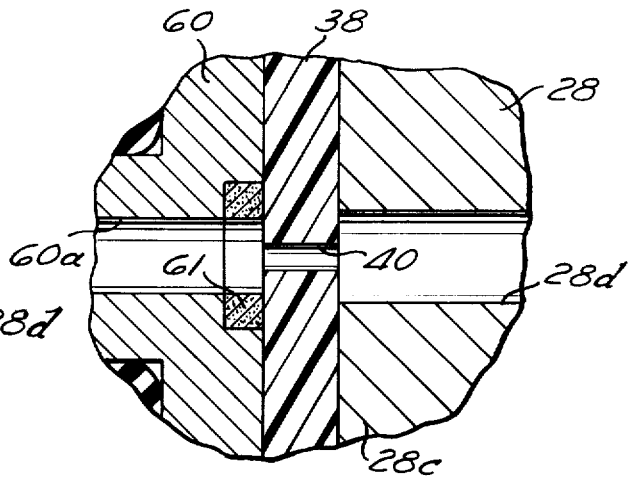
FIG. 3*a* is a sectional view similar to FIG. 3 showing the elastomeric member in a compressed condition with the pre-orifice opening having a reduced cross-sectional area substantially equal to the cross-sectional area of the spray tip opening.

As shown in FIG. 3*a*, the elastomeric disc 38 has been elastically deformed to provide the pre-orifice opening 40 with a reduced cross-sectional area. In this instance, the diameter of the pre-orifice opening has been reduced to about 0.011 inch which approximately provides a 1:1 area ratio between the pre-orifice opening and the smallest commercially available spray tip opening. (The conventional spray tip opening sizes vary from an area equal to that of a circle of 0.011 inch in diameter to an area equal to that of a circle of 0.035 inch in diameter.)

The pre-orifice opening 40 remains symmetrical and substantially cylindrical at a reduced, minimum cross-sectional area size, as well as intermediate sizes encountered as it is moved to a full open position. As a practical matter, the pre-orifice opening can be completely closed by further tightening the control knob 30 or rotating it in a clockwise direction as shown in FIG. 2, in order to move it in an axially rearward direction relatiive to the spray gun.

As depicted in FIG. 2, the long dimension of the spray tip opening 82 is perpendicular to the plane of the section and the spray gun. The spray nozzle assembly 34 is maintained in this position and rotationally fixed by means of pins 92 extending between the spray tip holder 78 and the adaptor 28, and passing through associated bores 93 in the capsule member 60 with an interference fit. One end of each of the pins 92 is received within a recess or hole 92*a* in the holder 78 and the other end is received within an aligned recess or hole 92*b* in the adaptor 28.

The adaptor 28 is provided with six angularly, equally spaced holes 92*b* (only two being shown) to provide three diametrically aligned pairs of holes in its forward face. The adaptor 28 is initially threadedly engaged with the boss 16*a* so that a pair of the aligned holes 92*b* is disposed along a line which is preferably within the plane of the spray gun (as shown in FIG. 2) or perpendicular thereto. It is convenient to use six holes 92*b* (or 3 aligned pairs of holes) in order to reduce the amount of additional deformation of the crushable gasket 58 beyond that amount necessary to obtain a fluid tight seal when the adaptor 28 is further tightened and rotated so as to dispose one of the aligned pairs of holes 92*b* in a preferred plane.

The spray tip holder 78 is provided with four angularly, equally spaced holes 92*a* (only two being shown) to provide two diametrically aligned pairs of holes in its rearward face. Accordingly, either pair of aligned holes 92*a* may be engaged with the pins 92 in order to rotationally fix the spray nozzle assembly 34 and major dimension of the oval shaped spray pattern relative to the spray gun. For example, the appropriate pairs of holes 92*a* and 92*b* may be aligned upon initial assembly of the spray gun so as to rotationally fix the spray nozzle assembly 34 as shown in FIG. 2 and provide an oval shaped spray pattern having its major dimension perpendicular to the plane of the spray gun. aligned If it is desired, in a particular spraying application to rotate the major dimensions of the spray fan and oval shaped spray pattern 90° relative to the plane of the spray gun, the control know 30 and knob closure member 32 together with the thrust washer 85 and entrapped Belleville springs 88, 89 are initially removed as a unit in order to permit the removal of the spray nozzle assembly 34 from the pre-orifice capsule assembly 36 which remains on the gun. The assembly 34 is then rotated to the desired position and the pins 92 engaged in the other pair of alinged holes 92*a* in the spray tip holder 78 to provide a 90° rotation of the spray pattern. Of course, the capsule member 60 having the pins 92 fitted therein may itself be removed, rotated to a desired position and the pins 92 engaged within a different pair of aligned holes 92*b* to provide additional angular orientations.

When the pre-orifice assembly 20 is initially secured to the spray portion 16 of the gun, the adaptor 28 is sufficiently tightened down to provide a fluid-tight seal with the valve body holder 48 by means of the crushable gasket 58. The pre-orifice capsule 36 and the spray nozzle assembly 34 are retained in fluid-tight sealing engagement by means of the axial loading applied thereto by the control knob 30. The low coefficient of friction of the plastic material used to form the control knob 30 and the thrust washer 85 minimizes frictional resistance encountered in applying axial loads to the chain of parts and enables the ready development of sufficient axial loads to maintain them in fluid tight sealing relationship.

The pre-orifice opening 40 is provided with an uncompressed diameter sufficiently greater than that of the adjacent portion of the bore 60*a* to maintain this relative size relationship even when a fluid-tight sealing load is applied to the elastomeric disc 38 and the cross-sectional area of the pre-orifice opening 40 is correspondingly decreased. Thus, the elastomeric disc 38 functions as a sealing gasket in its full open condition wherein unrestricted flow is permitted. Of course, it also functions as a sealing gasket when the cross-sectional area of the pre-orifice opening 40 is reduced to flow restrictive sizes.

As the cross-sectional area of the pre-orifice cpening is being increased from a flow restrictive size, the knob 30 in the illustrated embodiment is provided with an additional 270° of rotation after the area of the pre-orifice opening matches that of the opening 60*a* during which time a fluid-tight seal is maintained. In other words, when an operator desires to functionally remove the pre-orifice from the spray gun for purposes of high speed, rough work, the knob 30 may be rotated an additional 270° after he has achieved his objective without encountering fluid leaks or reducing the axial loading below the minimum load necessary to maintain the spray nozzle assembly and pre-orifice capsule in fluid-tight, sealing engagement.

If any fluid does leak into the pre-orifice spray assembly, it is vented through relief channels 32*c* and the spanner holes 32*b*. The relief channels 32*c* are formed by the intersection of the spanner holes 32*b* with the axially extending base wall of the annular chamber 86. The upper spanner hole 32*b* and relief channel 32*c* in FIG. 2 have been shown in dotted outline for purposes of clarifying the mounting of the Belleville springs 88, 89 and thrust washer 85 within the spray assembly 20.

The rotational adjustment range of the control knob 30 in providing deformation of the elastomeric member 38 and, more importantly, the pre-orifice functioning of the pre-orifice opening 40 at flow restrictive sizes is a function of the pitch of the threads between the knob 30 and the adapter 28 as well as the effective spring rate of the Belleville springs 88, 89. In addition, the adjustment sensitivity has also been found to be related to the hydraulic spraying pressure. For example, when the fluid pressure is relatively high (e.g. 3,000 psig or greater), the rotational adjustment of control knob 30 from a full open condition to a condition of substantial pre-orifice restriction may be as small as 45° or one-eighth of a turn. However, at a relatively low hydraulic pressure (e.g. 1500 psig.), the rotational adjustment will be as much as one-fourth to one-half turn for full open to substantial restrictive conditions. Accordingly, the pre-orifice effects in an average spray application at about 2,250 psig are controlled by about a 90° rotational adjustment with an additional 270° of leakage free rotation to provide a convenient adjustment range.

Figure 5:
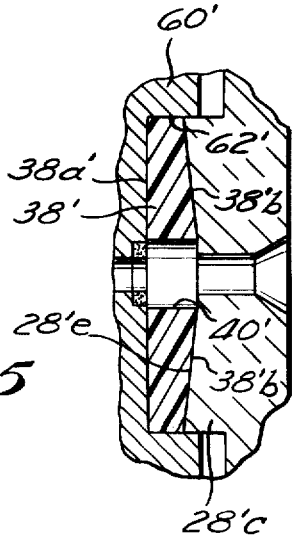
FIG. 5 is a sectional view through a portion of a pre-orifice capsule showing another embodiment of the present invention.

Referring to FIG. 5, a modified embodiment of the pre-orifice capsule is shown. For purposes of convenience, the parts of the modified embodiment have been designated with the same numbers as the corresponding parts of the embodiment shown in FIGS. 1 through 4, but for the addition of prime designations.

In FIG. 5, a pre-orifice capsule member 60′ includes a rearwardly extending cylindrical recess 62′ having a modified elastomeric pre-orifice disc or member 38′ disposed therein. The member 38′ has a generally conical configuration wherein the forward surface 38′*a* thereof is substantially planar and the rearward surface 38′*b* is sloped to provide a uniformly decreasing thickness in a direction radially outward from the pre-orifice opening 40′. The elastomeric member 38′ is shown in an uncompressed or fully open position, and the cylindrical shoulder or boss 28′*c* is provided with a concave forward face 28′*e* which corresponds to the configuration of the surface 38′*b*. Upon the axial loading of the elastomeric disc 38′, the mating surfaces 38′*b* and 28′*e* cooperate to provide a radially inward component of loading upon the member 38′ to facilitate its radial deformation.

What is claimed is:

1. An airless paint spray gun comprising a body portion having a conduit adapted to be connected at its inlet end to a source of liquid paint under pressure and adapted to have a spray tip having an elongated spray opening connected to the discharge end thereof, pre-orifice means adjacent the discharge end of said conduit including an elastomeric disc having a central aperture forming an axially extending pre-orifice opening adjustable in cross-sectional area, said pre-orifice means including relatively movable rigid wall means engaging and confining the opposite sides of said disc radially outward from the central aperture thereof, said relatively movable wall means having axial openings aligned with and of substantially no greater diameter than said central aperture, and manually operable means associated with said pre-orifice means operable to move said relatively movable wall means toward each other to elastically deform said disc and to reduce the diameter of said pre-orifice opening to a diameter less than those of said axial openings.

2. An airless paint spray gun as set forth in claim 1 wherein said manually operable means include spring means operably arranged to apply a predetermined axial load to said pre-orifice means.

3. An airless paint spray gun as set forth in claim 2 wherein said pre-orifice means include capsule means having said elastomeric disc mounted therein, said capsule means providing one of said relatively movable wall means and being mounted for axial movement toward the other of said wall means to provide deformation of said elastomeric disc in response to axial loading by said spring means.

4. An airless paint spray gun as set forth in claim 3 wherein said manually operable means include a control member externally mounted on said body portion for threadedly loading and unloading said spring means.

5. An airless paint spray gun as set forth in claim 1 wherein said elastomeric disc comprises a polyurethane elastomeric disc having a substantially cylindrical configuration.

6. In an airless paint spray gun comprising a body portion having a conduit adapted to be connected at its inlet end to a source of liquid under pressure and adapted to have a spray tip providing an elongated spray opening connected to the discharge end of said conduit, the improvement comprising an adjustable pre-orifice assembly in said conduit upstream from said spray opening including a radially disposed resilient wall having an aperture therethrough defining a pre-orifice opening coaxially aligned with respect to said spray opening, said pre-orifice assembly also including rigid wall means for confining said resilient wall against radial outward deformation and relatively movable rigid wall means engaging and confining the opposite radial surfaces of said resilient wall radially outward from said pre-orifice opening, said relatively movable wall means having axial openings aligned with and of no greater diameter than said pre-orifice opening in a non-restrictive flow condition, said resilient wall being elastically deformable to reduce the diameter of said pre-orifice opening from said non-restrictive flow condition to a restrictive flow condition in response to axial loads applied to said relatively movable wall means by manually operable means associated with said pre-orifice assembly.

7. In an airless spray gun comprising a body portion with a passage for liquid paint adapted to be connected at its inlet end to a source of liquid paint under pressure and adapted to have a flat fan spray tip having an elongated spray opening connected to the discharge end of said passage, the improvement comprising a pre-orifice assembly including a transversely disposed elastomeric member defining a co-axially extending pre-orifice opening adjustable in cross-sectional area upstream in said passage from said spray tip, said pre-orifice opening being defined by the wall of an opening extending through said elastomeric member and having a diameter in a full open position greater than that of the adjacent upstream passage, and manually operable means carried by said body portion operably associated with said pre-orifice means and movable to reduce the area of said pre-orifice opening to an area at least substantially equal to the area of said elongated spray opening.

8. The improvement set forth in claim 7 wherein said pre-orifice assembly includes means for radially confining said elastomeric member at a location radially outward from said pre-orifice opening and relatively movable rigid wall means engaging and confining opposite transversely extending surfaces of said elastomeric member radially outward of said pre-orifice opening.

9. The improvement set forth in claim 7 wherein said pre-orifice assembly includes capsule means having said elastomeric member mounted therein, said capsule means including forwardly projecting, connecting means for detachably securing said pre-orifice assembly to a spray tip to provide an integrally removable assembly thereof.

10. An airless paint spray gun comprising a body portion with a conduit therethrough adapted to be connected to a source of paint under pressure, a spray tip having an elongated spray opening connected to said conduit, an adjustable pre-orifice assembly in said conduit upstream from said spray opening, said pre-orifice assembly including an elastomeric disc having a central aperture defining an axially extending pre-orifice opening adjustable in cross-sectional area, said pre-orifice assembly including a relatively movable capsule member for confining radially outward flow of said elastomeric member and cooperating with a fixed portion of said spray gun to engage and confine opposite faces of said elastomeric disc radially outward of said pre-orifice opening, and manually operable means carried by said body portion operably associated with said pre-orifice assembly to move said capsule member and to elastically deform said elastomeric means to vary the area of said pre-orifice opening.

11. In an airless paint spray gun comprising a body portion with a passage for paint under pressure, a flat fan spray tip having an elongated opening secured to said body portion in communication with the outlet end of said passage, the improvement comprising rotational locking means for maintaining said spray tip in a preselected angular orientation relative to said body portion, a resilient member disposed between said said spray tip and said body portion having an aperture therethrough communicating between said spray tip and the outlet end of said passage, and manually operable means externally carried by said body portion and threadedly engaged therewith for mounting said spray tip in fluid tight sealing relationship with said body portion adjacent the outlet end of said passage, said manually operable means including wall means arranged for axial movement relative to said body portion upon operation of said manually operable means, and said manually operable means also including spring means entrapped between said wall means and spray tip for transmitting axial biasing loads to said spray tip to compress said resilient member and maintain said spray tip in fluid tight sealing relationship.

12. In an airless paint spray gun comprising a body portion having a conduit adapted to be connected at its inlet end to a source of liquid paint under pressure and adapted to have a spray tip connected to the discharge end thereof, a pre-orifice assembly adjacent the discharge end of said conduit including an axially extending pre-orifice opening adjustable in cross-sectional area, and manually operable means carried by said body portion operably associated with said pre-orifice assembly and movable to vary the area of said pre-orifice opening, the improvement comprising an elastomeric member having an aperture extending therethrough defining said pre-orifice opening, said pre-orifice opening having a diameter in a full open position greater than that of an adjacent upstream conduit, and the manually operable means being adapted to elastically deform said elastomeric member and reduce the cross-sectional area of said pre-orifice opening to an area at least substantially equal to the area of the spray tip opening of a connected spray tip.

* * * * *